US006018153A

United States Patent [19]

Matsuda et al.

[11] Patent Number: 6,018,153

[45] Date of Patent: Jan. 25, 2000

[54] INPUT CONTROL DEVICE, COOKING APPARATUS USING AN INPUT CONTROL DEVICE AND METHOD OF OPERATION

[75] Inventors: Masato Matsuda, Shiki-gun; Yasuteru Fujii, Gojo; Takamasa Okutsu, Nara; Mitsuo Ebisawa, Souraku-gun; Masashi Yano, Uda-gun, all of Japan

[73] Assignee: Matsushita Electric Industrial Co., Ltd., Osaka, Japan

[21] Appl. No.: 09/000,187

[22] PCT Filed: Jul. 17, 1996

[86] PCT No.: PCT/JP96/01989

§ 371 Date: Jan. 20, 1998

§ 102(e) Date: Jan. 20, 1998

[87] PCT Pub. No.: WO97/04275

PCT Pub. Date: Feb. 6, 1997

[30] Foreign Application Priority Data

Jul. 17, 1995 [JP] Japan ..... 7-182486

[51] Int. Cl.[7] ..... H05B 1/02

[52] U.S. Cl. ..... 219/506; 219/702; 364/477.1

[58] Field of Search ..... 219/506, 702, 219/720; 364/477.01; 99/325

[56] References Cited

U.S. PATENT DOCUMENTS

| | | | |
|---|---|---|---|
| 4,933,527 | 6/1990 | Edamura | 3/702 |
| 4,972,069 | 11/1990 | Edamura | 219/702 |
| 5,272,300 | 12/1993 | Edamura | 219/702 |
| 5,373,142 | 12/1994 | Ohshima et al. . | |
| 5,438,180 | 8/1995 | Eisenbrandt et al. | 219/492 |
| 5,654,739 | 8/1997 | Sakaia et al. | 345/134 |

FOREIGN PATENT DOCUMENTS

| | | |
|---|---|---|
| 60-170608 | 11/1985 | Japan . |
| 62-26421 | 2/1987 | Japan . |
| 63-182632 | 7/1988 | Japan . |
| 1-134119 | 5/1989 | Japan . |
| 1-134120 | 5/1989 | Japan . |
| 4-009524 | 1/1992 | Japan . |
| 4-9524 | 1/1992 | Japan . |
| 5-27228 | 2/1993 | Japan . |
| 62-65149 | 9/1994 | Japan . |

*Primary Examiner*—Tu Ba Hoang
*Assistant Examiner*—Jeffrey Pwu
*Attorney, Agent, or Firm*—Ratner & Prestia

[57] ABSTRACT

To present an operating apparatus having features including ease of operation, controllability for preventing misoperation, small size, long life, and ease of assembling. The constitution includes a base unit as skeleton of operation unit, a key operation unit (13) having plural switches disposed at the front side of the base unit, a first design sheet (12) disposed at the front side of the key operation unit (13), printing patterns at positions corresponding to each switch, a display device (11) disposed at the front side of the first design sheet (12), having light function elements **(11*g*) for transmitting and shielding the positions corresponding to the patterns on the first design sheet (12), and a second design sheet (10) disposed at the front side of the display device (11), having windows (10*b*)** at positions corresponding to the light function elements. By manipulating a desired window, the light function element is set in light transmission state, and the pattern printed on the first design sheet is displayed in the window.

24 Claims, 6 Drawing Sheets

INPUT CONTROL DEVICE, COOKING APPARATUS USING AN INPUT CONTROL DEVICE AND METHOD OF OPERATION

THIS APPLICATION IS A U.S. NATIONAL PHASE APPLICATION OF PCT INTERNATIONAL APPLICATION PCT/JP96/01989.

TECHNICAL FIELD

The present invention relates to an operating apparatus, for example, an operating apparatus used in high frequency heating apparatus and electric cooker.

BACKGROUND ART

Hitherto, in a cooker, for example, a high frequency heating apparatus, the menu has been subdivided in order to cook without failure. In addition, by the recent progress in sensor technology, automation and functional sophistication of cooking have been advanced. As a result, by the increase in the number of keys in the operating apparatus and sharing of keys, the operation is complicated, and it is less easier to use. Still more, in the conventional operating apparatus, the display unit and operation unit were placed at different positions. It was hence necessary to observe the display unit and operation unit separately, and handling was confusing, and wrong handling tended to occur.

On the other hand, a microwave oven is proposed as disclosed in Japanese Patent Publication 4-9524. The operation unit of this microwave oven comprises expensive and complicated liquid crystal display and transparent electrode switch sheet. In this constitution, the operation unit is complicated in the assembling work structurally, and the display is poor in transparency, and the life of the display unit is short.

A conventional operating apparatus is described specifically below. As a conventional high frequency heating apparatus, a microwave oven is described by referring to FIG. 10. FIG. 10 is a perspective view of a main body of a conventional high frequency heating apparatus. In FIG. 10, at the front side of the main body 39 of the high frequency heating apparatus, there are plural display units 31, 32, 33, 34, 35, operation units 36, 37, and a door 38 opening and closing for putting food in and out of heating compartment. In this constitution, the display units and operation units are in different layout. Therefore, it is required to observe plural positions while operating. As a result, it is hard to confirm the operating state. It is inconvenient to use because it is required to refer to both display units and operation units during manipulation. It is further possible to select wrong operation keys or fail in cooking. Still worse, it is expensive, poor in productivity, and short in life.

SUMMARY OF THE INVENTION

It is hence a primary object to present an operating apparatus having features including ease of operation, controllability to suppress misoperation, small size, long life, and ease of assembling.

The operating apparatus of the invention comprises a base unit as skeleton of operation unit, a key operation unit disposed at the front side of the base unit, a first design sheet disposed at the front side of the key operation unit, a display device disposed at the front side of the first design sheet, and a second design sheet disposed at the front side of the display device.

The second design sheet forms plural windows, and plural second display means are provided in or around the windows. The display device has plural light function elements having functions of light transmission and light shielding at positions corresponding to the plural windows. The first design sheet has plural display means at positions corresponding to the plural light function elements. The key operation unit has plural switch means, and is electrically connected to the display device, and controls application and cancellation of electric field to the plural light function elements in response to the operation to the windows.

In this constitution, since the display units coincide with the operation units, operation by pressing or the like is easy, and misoperation can be prevented. Moreover, since the display units and operation units coincide, the entire surface of the operating apparatus can be used as operation units. Therefore, in the operating apparatus of a same size, more operation units can be designed. Yet, more effective use is possible, and the operating apparatus may be further reduced in size.

Further, only the necessary information can be displayed in the window, and the operator can handle without being disturbed by other unnecessary information.

The operating apparatus may be reduced in size.

By sealing the outer circumference of the display device, deterioration of light function element is prevented, and the reliability is extremely enhanced.

The plural second display means are particularly desired to be plural menu names.

The second design sheet is particularly desired to have a barrier layer for shielding ultraviolet rays.

The plural windows are particularly desired to be transparent.

The display device is particularly desired to have a control unit.

Moreover, as compared with the conventional operating apparatus disposing display elements such as lamps corresponding to the keys, the number of parts is notably decreased in the operating apparatus of the invention, and hence the cost is extremely lowered, and the structure is simple and assembling is easy.

By attaching a frame around the second design sheet, the reliability of the operating apparatus is notably enhanced.

In the constitution integrating the first design sheet; display device and second design sheet, deterioration of light function elements is prevented, and the reliability is enhanced extremely.

In other aspect of the invention, the operating apparatus comprises:

key operation means having plural switch means, a first design sheet having plural first display means disposed at the front side of the key operation means, a display device having plural light function elements disposed at the front side of the first design sheet, a second design sheet having plural windows and second display means disposed at the front side of the first design sheet, and control means connected electrically to at least one of the display device and key operation means.

The operating apparatus is constituted by locating each window of the plural windows and each light function element of the plural light function elements, and each first display means of the plural first display means and each switch means of the plural switch means, at mutually confronting positions, respectively.

The operating method of the invention makes use of the above operating apparatus. First, when a first window of the plural windows is pressed, a first light function element located at the position corresponding to the first window is in light transmission state, and a first display means corresponding to the first light function element is displayed in the manipulated window, and further to urge next operation, a second light function element located at a position corresponding to a second window of the plural windows repeats between light transmission state and light shielding state, and other first display means corresponding to the second light function element is displayed by flickering in the second window.

When the flickering second window is pressed, the second light function element located at the position corresponding to the second window is set in light transmission state, and other first display means corresponding to the second light function element is displayed in the second window, and further to urge next operation, a third light function element located at a position corresponding to a third window of the plural windows repeats between light transmission state and light shielding state, and other first display means corresponding to the third light function element is displayed by flickering in the third window. Thereafter, the same operation is repeated for a desired number of tines. Finally, the flickering window is pressed, and desired operation is started.

Thus, the operating method of the operating apparatus is constituted. In this constitution, in addition to the above effects, an interactive operation is realized so that the user can operate at ease.

Other constitution of the invention is a heating cooker mounting the operating device of such constitution. As the heating cooker, a high frequency heating cooker is particularly preferred. In this constitution, the above actions and effects are particularly notable.

BEST MODES OF CARRYING OUT THE INVENTION

Figure 1:
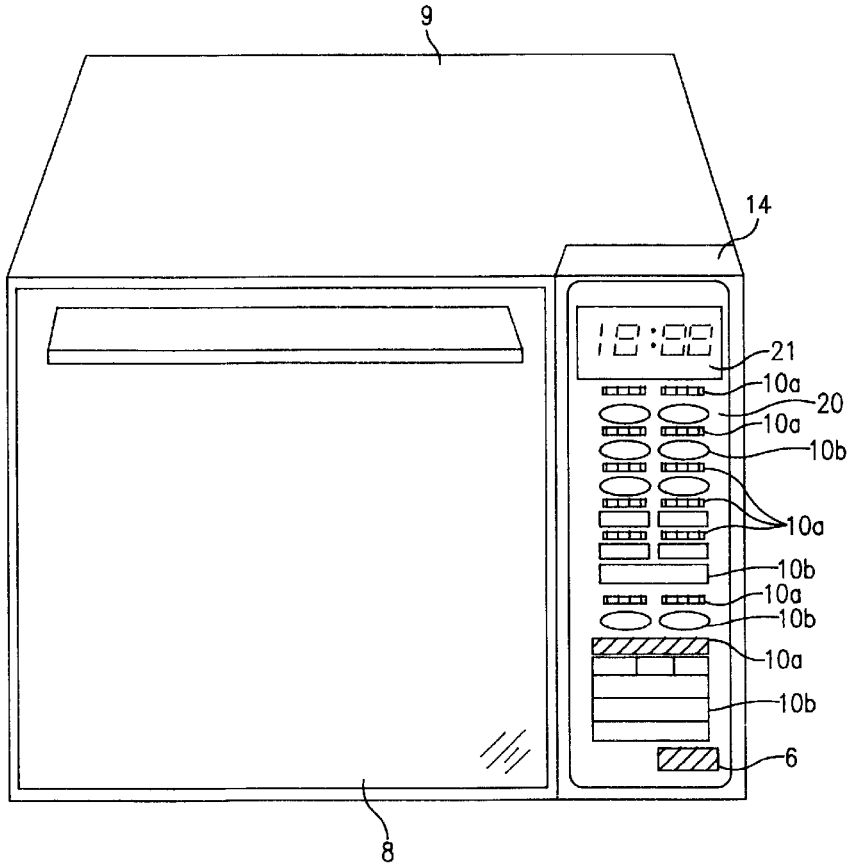
FIG. 1 is a perspective view of a main body of a high frequency heating apparatus employing an operating apparatus according to an embodiment of the invention.

Referring now to the drawings, embodiments of the operating apparatus of the invention are described in detail below.

FIG. 1 is a perspective view of main body of a high frequency heating apparatus using an operating apparatus in an embodiment of the invention. In FIG. 1, a door 8 is disposed at the front side of a body 9 of the main body of the high frequency heating apparatus. The food to be heated is accommodated inside of the door 8. Beside the door 8 is disposed an operating apparatus 20 supported by a base unit 14. Clock display means 21 is installed at the upper side of the operating apparatus 20. This clock display means 21 displays the time and others.

Figure 3:
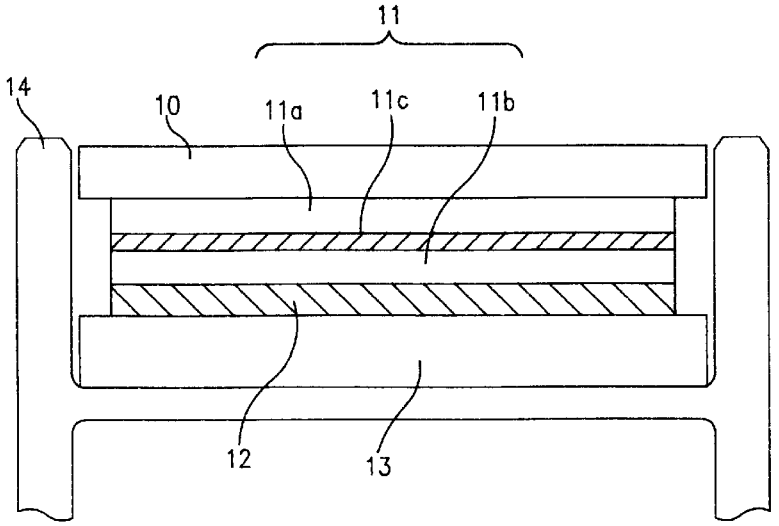
FIG. 3 is a schematic sectional view of the operating apparatus in FIG. 2.
Figure 2:
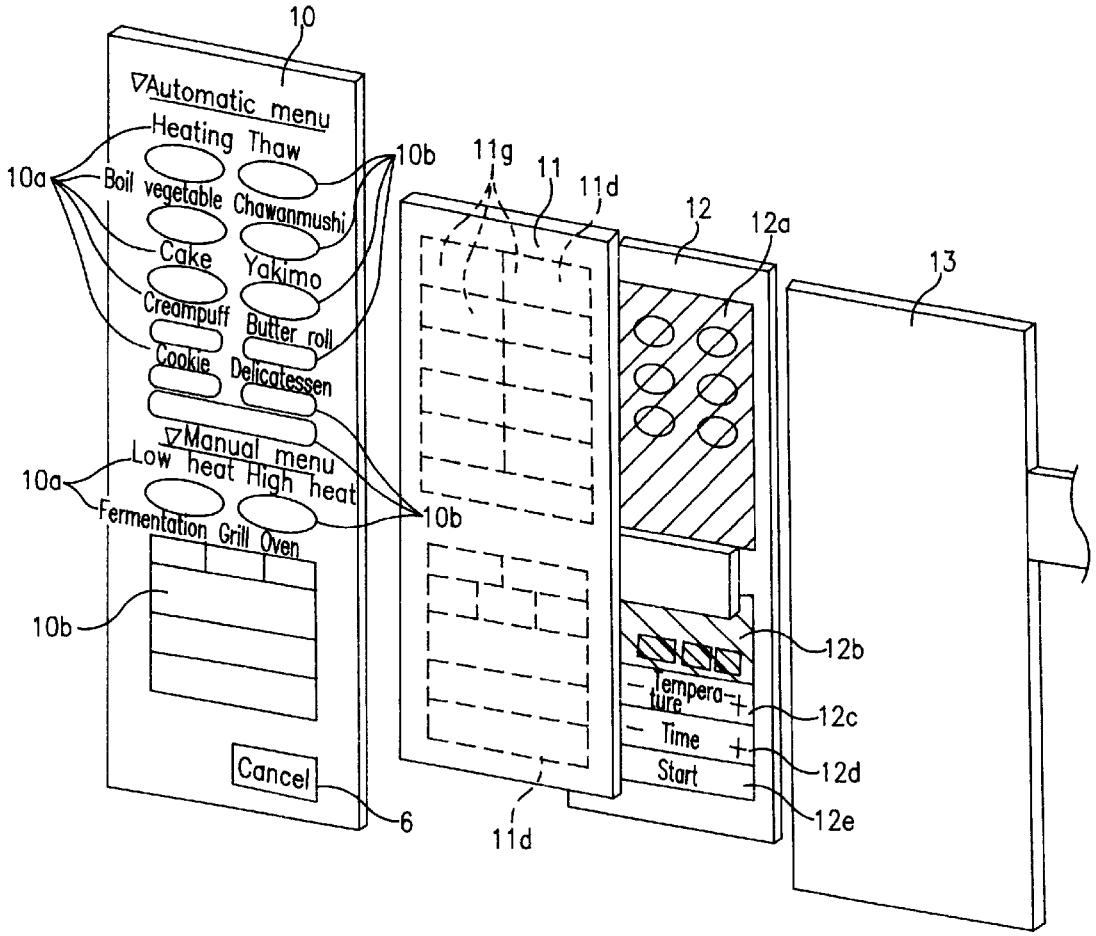
FIG. 2 is a perspective view showing the structure of the operating apparatus of the high frequency heating apparatus shown in FIG. 1.

FIG. 2 is a perspective view showing the structure of the operating apparatus of the high frequency heating apparatus shown in FIG. 1. FIG. 3 is a schematic diagram of a section of principal parts of the operating apparatus shown in FIG. 2. In FIG. 2 and FIG. 3, the base unit 14 is the skeleton of the operating apparatus. Key operation means 13 is installed at the front side of the base unit 14. A first design sheet 12 is disposed at the front side of the key operation means 13. Plural first display means such as fluorescent color patterns 12*a*, 12*b*, and characters 12*c*, 12*d*, 12*e* are printed at specified positions of the first design sheet 12.

A display device 11 is disposed at the front side of the first design sheet 12. The display device 11 has plural light function elements 11*g* having the functions of light transmission and light shielding. The plural light function elements 11*g* are formed at positions corresponding to the plural first display means. A second design sheet 10 is disposed at the front side of the display device 11. The second design sheet 10 has plural windows 10*b*. The plural windows 10*b* are formed at positions corresponding to the plural first display means and plural light function elements 11*g*. Near or around each window of the plural windows 11*b*, moreover, plural menu names 10*a* and other first display means are printed.

The constitution of the display device 11 is specifically described below. The display device 11 has the function of allowing the first display means formed in the first design sheet 12 to be visible from the front side, and shielding to be invisible. In FIG. 3, the display device 11 is composed of a first transparent sheet 11*a*, a second transparent sheet 11*b*, and a liquid crystal material 11*c*. The liquid crystal material 11*c* is a kind of the light function elements 11*g*. In the first and second transparent sheets 11*a* and 11*b*, transparent patterns of a first transparent electrode 11*d* and a second transparent electrode lie of transparent and conductive property made of indium oxide or metal are disposed, respectively. In order that the first transparent sheet 11*a* and second transparent sheet 11*b* may keep a specific interval from each other, moreover, the first transparent electrode 11*d* and second transparent electrode 11*e* are disposed so as to confront each other, and a spherical liquid crystal material 11*c* is disposed between the first transparent sheet 11*d* and second transparent sheet 11*e*.

Figure 4A:
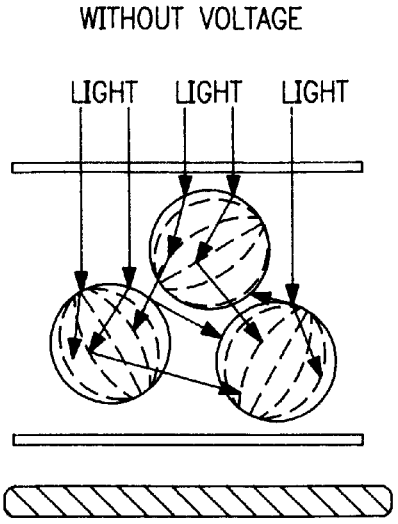
FIG. 4 is a diagram explaining the principle of operation of display device constituted in the invention.
Figure 4B:
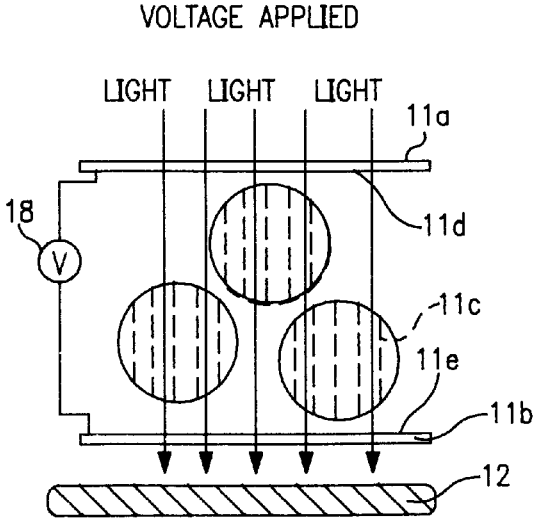

The operating principle of the display device is described below. FIG. 4 is a schematic diagram for explaining the operating principle of the display device. In FIG. 4, as shown in (b), when a voltage 18 is applied between the first transparent electrode 11*d* and second transparent electrode 11*e*, the liquid crystal material 11*c* is arrayed along the electric field. Therefore, the light is in transmission state, and hence when seen from the front side, the pattern or character as the first display means of the first design sheet 12 passes through the display device 11. On the other hand, as shown in (a), when the voltage 18 is cut off, the liquid crystal material scatters and absorbs the light. As a result, the display device 11 cuts off the first display means of the first design sheet 12.

In this constitution, the second display means is the character or pattern printed on the surface of the second design sheet, but not limited to this, other arbitrary display means may be also used. For example, a transparent sheet having character or pattern may be adhered.

The material of the first design sheet 10 and second design sheet 12 is not particularly limited, but, for example, plastic materials such as polyethylene terephthalate are used. The thickness of the second design sheet 12 is about 250 micrometers. The total thickness of the display device 11 and first design sheet 10 is about 300 micrometers. The individual thickness of the first design sheet 10, display device 11 and second design sheet 12 is not particularly defined, but when the window 10*b* of the second design sheet 12 is pressed, the thickness is desired to be enough to transmit the pressing force to the key operation means 13.

The key operation means 13 has plural switch means, and each switch means of the plural switch means has a switch function corresponding to the pressing force of each window 10*b*. That is, when the window 10*b* is pressed, its pressing force is transmitted to a specified position of the key operation means 13, and an electric field is applied to the first transparent electrode 1*d* and second transparent electrode 1*e* of the light function element 11*g* at the position corresponding to the pressed window 10*b*. As a result, the liquid crystal 1*c* of the light function element at the position is set in light transmission state.

The operating method and action of the above constitution are described below. In this constitution, when the user presses a desired window 10*b* of the plural windows 10*b* of the second design sheet 10, its pressing force is transmitted to the key operation means 13, and by the switch function of the key operation means 13, the liquid crystal material 11*c* of one light function element 11*g* corresponding to the pressed window 10*b* is set in light transmission state. Therefore, one first display means (for example, pattern 12*a* or character 12*c*) positioned deep inside corresponding to this light function element 11*g* is visible from the user side. That is, the first display means is displayed in the pressed portion of the window 10*b*.

Thus, according to the embodiment, by input operation of the display unit, selection of menu and setting of cooking conditions are enabled. Therefore, it is liberated from the conventional confusing operation of referring to plural positions of the display unit and operation unit. Furthermore, the display information shown in the display area is only the necessary information of the pressed position, and other unnecessary information is not displayed. Therefore, ease of handling is enhanced, and misoperation may be prevented.

In this constitution, for example, by disposing menu names and other second display means on the surface of the second design sheet 10, the cooking information can be displayed more clearly.

The display position of the second display means is not particularly limited, but it is particularly preferred to display in the peripheral area of each window 10*b* of the second design sheet 10. In this constitution, apparent defect such as deviation of printing of display means and deviation of pasting may be prevented, and the quality of appearance is enhanced.

The first display means and second display means are not particularly limited, but patterns, characters, graphics, symbols, numerals, and lines are used. The form of the first display means and second display means is not particularly limited, but, for example, it is possible to dispose by printing, or a thin sheet forming patterns or characters may be disposed.

As the light function elements 11*g* used in the display device 11, a material having functions of both light transmission and light shielding by electric control is particularly desired.

Figure 5:
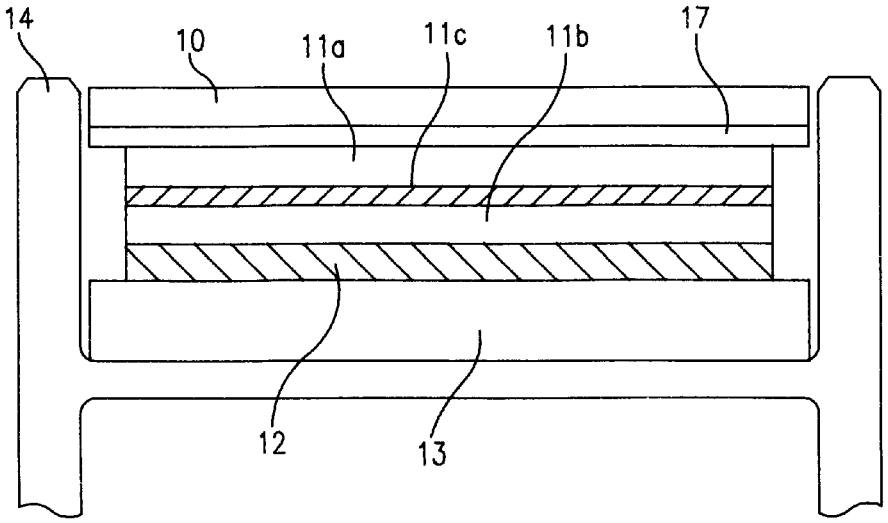
FIG. 5 is a sectional view of an operating apparatus in other embodiment of the invention.
Figure 6A:
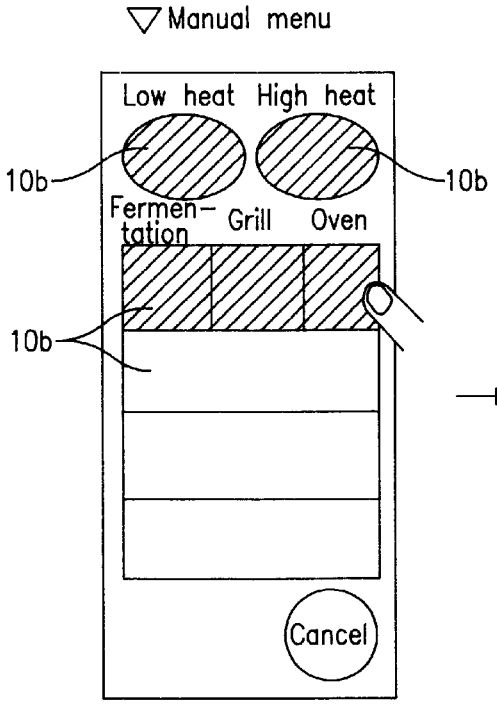
FIG. 6 is an explanatory diagram of operation of display unit of an operating apparatus used in a cooker in a different embodiment of the invention, in which (a) shows an initial state of display unit, (b) shows setting operation of temperature, (c) shows setting operation of time, and (d) shows operation of start button.
Figure 6B:
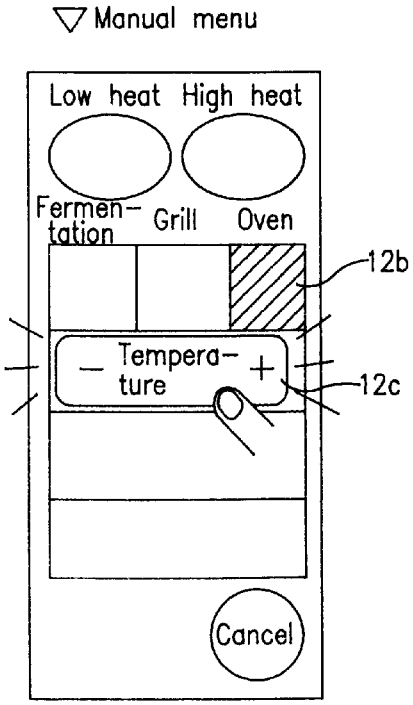
Figure 6C:
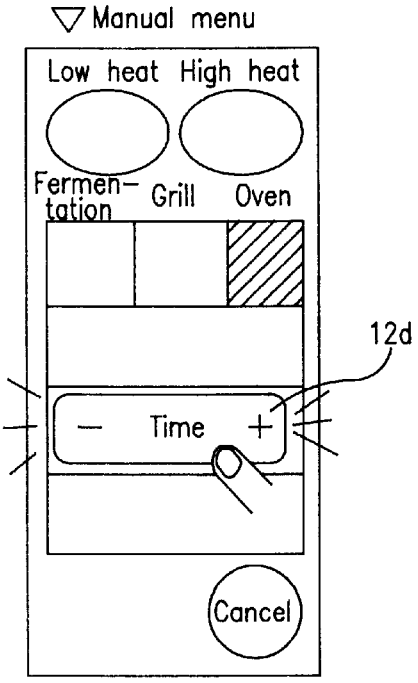
Figure 6D:
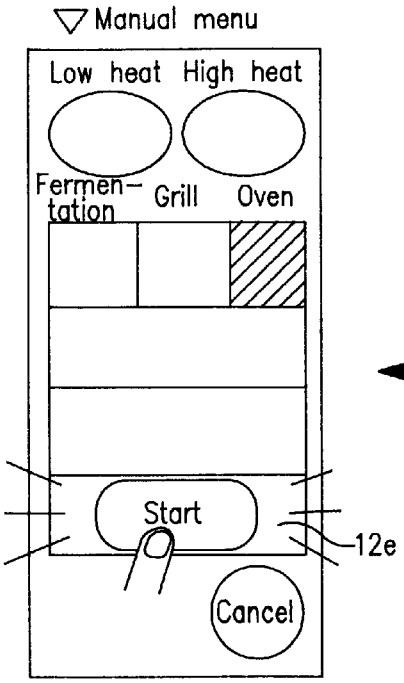

Hereinafter, a second embodiment of the operating apparatus of the invention is described by referring to the drawing. FIG. 5 is a schematic diagram of a section of the operating apparatus in the second embodiment of the invention.

In FIG. 5, on the surface of the inner side of the second design sheet 10, a UV barrier layer 17 having a function of cutting off ultraviolet rays as ultraviolet ray barrier means is disposed. The other constitution is same as the constitution shown in FIG. 2 and FIG. 3. The UV barrier layer 17 is formed, for example, by printing in ink. As the UV barrier layer 17, meanwhile, it is also possible to use a transparent sheet having a function of cutting off the ultraviolet rays disposed between the second design sheet 16 and display device 11.

In this constitution, deterioration of the light function elements 11*g* used in the display device 11 due to ultraviolet rays can be suppressed.

A third embodiment of the operating apparatus of the invention is described below. This constitution comprises control means, in addition to the constitution shown in the first embodiment. When one specific window is manipulated out of plural windows, the control means displays the manipulated window, and simultaneously controls to flicker the display in other windows to urge next operation. That is, the control means controls appearance and cutoff of the display of the specified window by the display device. To urge next operation, the control unit has a function of controlling the liquid crystal material of a specific light function element of the plural light function elements. The control means is not particularly limited, but is installed, for example, at the back side of the key operation means 13.

An embodiment of the invention described below is a case of heating and cooking in the "oven" state of the manual menu of the operating apparatus used in the high frequency cooking apparatus. FIG. 6 shows each state of display unit of the operating apparatus of the cooker in an embodiment of the operating apparatus of the invention. First, as shown in FIG. 6(*a*), when the "oven" button of window 10*b* is pressed, the liquid crystal material 10*c* corresponding to the "oven" window 10*b* is set in light transmission state. Therefore, the pattern 12*b* of the first design sheet 12 corresponding to "oven" is reproduced at the "oven" position of the window 10*b*, and is displayed. When this pattern 12*b* is displayed, simultaneously, as shown in FIG. 6(*b*), the liquid crystal material 11*c* corresponding to "temperature" window 10*b* repeats light transmission and light shielding, and the "temperature" display of other character 12*c* of the first display means flickers at the "temperature" position of the window 10*b*. This flickering urges the user to do next operation. Next, when the desired temperature is set by the user by manipulating "temperature," as shown in FIG. 6(*c*), the liquid crystal material 11*c* corresponding to the "time" window 10*b* repeats light transmission and light shielding, and the "time" display of other character 12*d* of the first display means flickers at the position of "time" of the window 10*b*. This flickering urges the user to do next operation. When the user further manipulates "time" and sets a desired time, as shown in FIG. 6(*d*), the liquid crystal material 11*c* corresponding to the "start" window 10*b* repeats light transmission and light shielding, and the "start" display of other character 12*e* of the first display means flickers at the position of "start" of the window 10*b*. This flickering urges the user to do next operation. The user presses "start" button to start cooking. Thus, in this embodiment, according to the manipulation by the user, the control means displays the window at desired position of the display device, and at the same time controls to flicker other window to urge the user for next operation. In this constitution, the interactive operation is realized, so that the user can cook at ease.

A fourth embodiment of the operating apparatus of the invention is described below by referring to the drawings.

Figure 7:
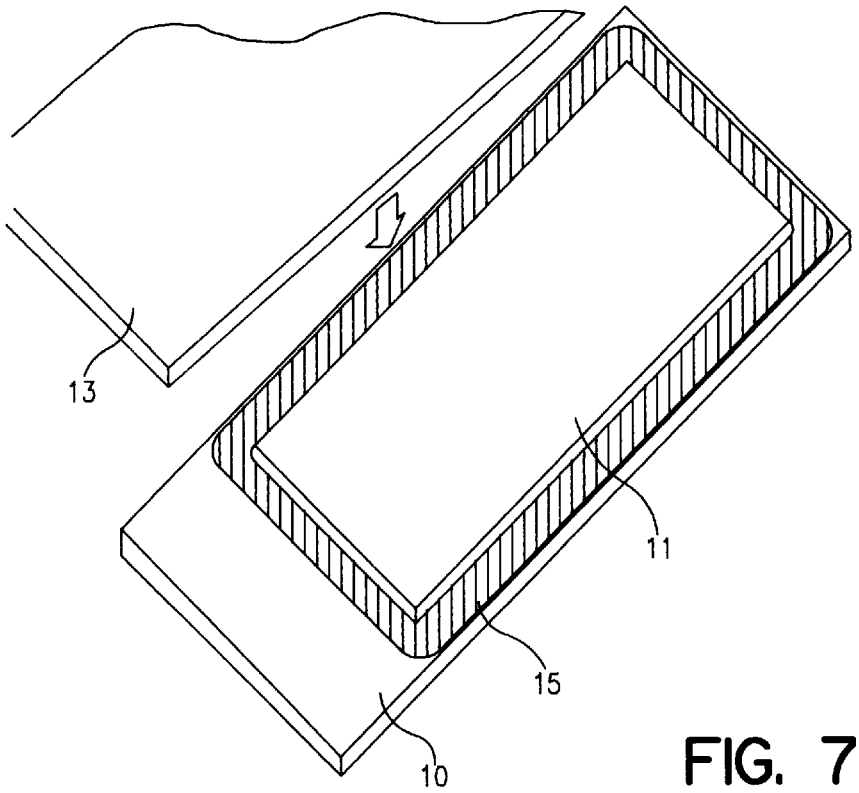
FIG. 7 is a perspective view showing structure of an operating apparatus in a further embodiment of the invention.
Figure 8:
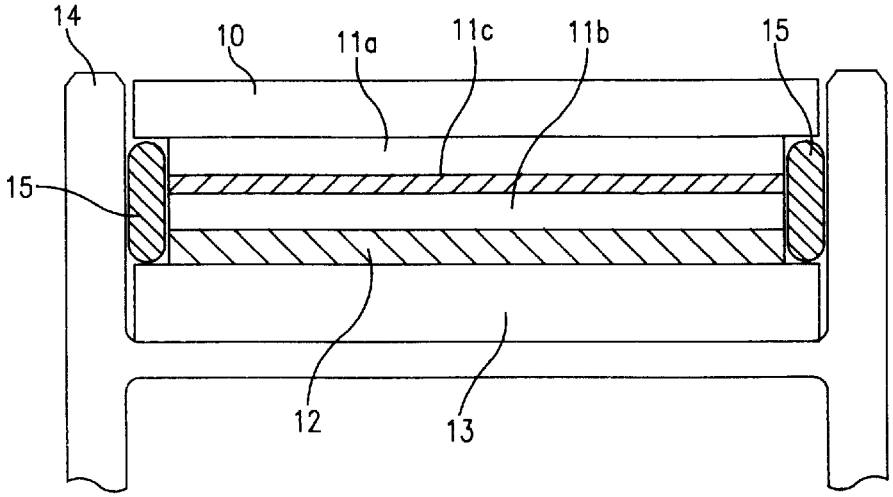
FIG. 8 is a sectional view of the operating apparatus shown in FIG. 7.

FIG. 7 is a perspective view showing the constitution of an operating apparatus in a further different embodiment of the invention. FIG. 8 is a schematic diagram of a section of the operating apparatus shown in FIG. 7. In FIG. 7 and FIG. 8, seal means 15 is disposed on the outer circumference of the end face of the display device 11. The other constitution is same as the constitution in FIG. 2 and FIG. 3. After gluing the first design sheet 12 and display device 11, the outer circumference of the end face of the display device 11 is sealed by the seal means 15. The display device 11 sealed by the seal means 15 is integrated with the second design sheet 10 by holding together with the key operation means 13. In this constitution, invasion of foreign matter (for example, water, alkaline detergent, seasoning) into the liquid crystal material, or effects of static electricity can be prevented. The material of the seal means 15 is not particularly limited, but, for example, silicone rubber, synthetic rubber, and other sealing material may be used.

A fifth embodiment of the operating apparatus of the invention is described below by reference to the drawing.

Figure 9:
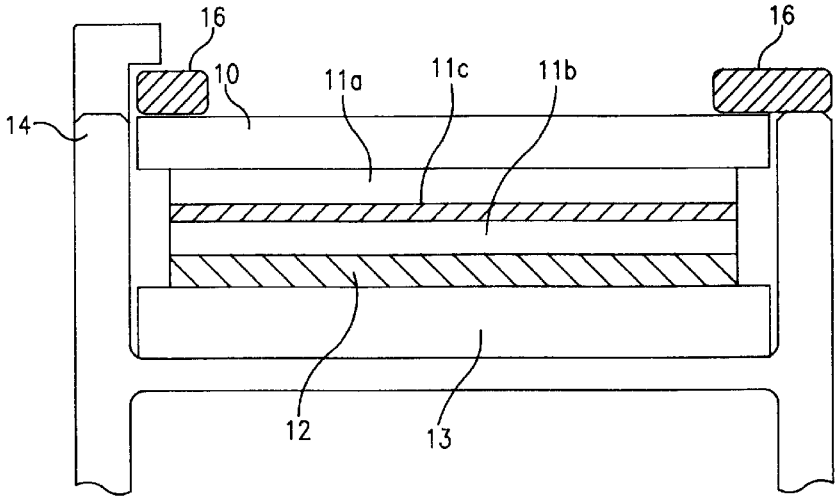
FIG. 9 is a sectional view of an operating apparatus in a further different embodiment of the invention.
Figure 10:
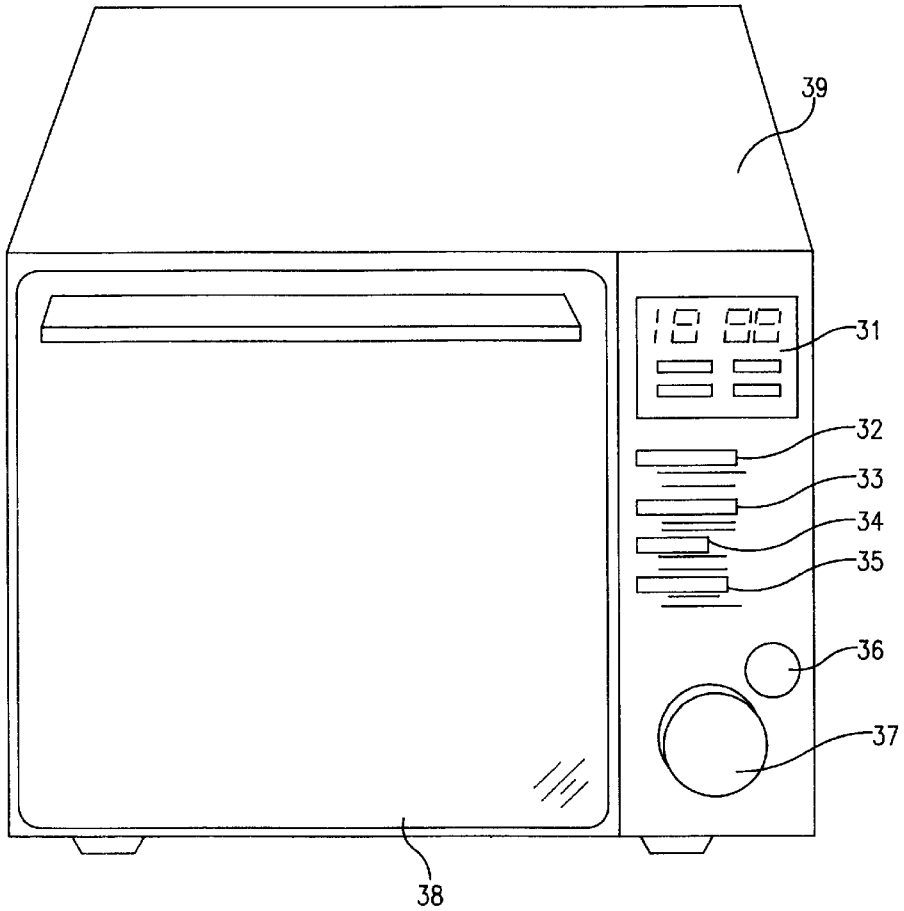
FIG. 10 is a perspective view of main body of a conventional high frequency heating apparatus.

FIG. 9 is a schematic diagram of a section of an operating apparatus in a still further different embodiment of the invention. In FIG. 9, a frame 16 is disposed around the front side of the second design sheet 10. The other constitution is same as the constitution of the operating apparatus in FIG. 2 and FIG. 3. According to this constitution, effects of static electricity on the liquid crystal material 11*c* used in the display device 11 can be prevented in the spatial distance. The frame 16 is not particularly limited, but a molded piece of plastic material in a specific shape may be used.

Herein, the operating apparatus of the invention is used in the high frequency heating apparatus, but the operating apparatus of the invention may be also used in other electrical appliances such as electric dryer and washing machine.

INDUSTRIAL APPLICABILITY

In the constitution of the invention, since the display unit and operation unit coincide, the pressing operation is easy, and misoperation can be prevented. Moreover, since the display unit and operation unit coincide, the entire surface of the operating apparatus can be used as the operation unit. Therefore, as compared with the operating apparatus of same size, more operation units can be designed, and further effective manner of use is realized, and the operating apparatus may be reduced in size.

Besides, only the necessary information is displayed in the window, and it is possible to operate without being disturbed by other unnecessary information.

By installation of control means, it is possible to operate according to the flickering display, and it is easy to operate, and interactive operation is realized.

As compared with the conventional operating apparatus having display elements such as lamps corresponding to each key, the number of parts is dramatically decreased in the operating apparatus of the invention, and hence the cost is notably reduced, the structure is simple, and assembling is easy.

Moreover, the operating apparatus may be reduced in thickness.

By the constitution of sealing the outer circumference of the display device, deterioration of light function elements due to effects of static electricity or foreign matter may be prevented, so that the reliability may be enhanced greatly.

By installing a frame around the second design sheet, effects of static electricity on the light function elements are suppressed, and the reliability is notably improved.

Still more, by the integrated structure of first design sheet, display device and second design sheet, deterioration of the light function elements is prevented, and hence the reliability is dramatically enhanced.

The heating cooker mounting the operating apparatus of the invention is particularly notable in these effects. Furthermore, as the heating cooker, the high frequency heating apparatus is particularly preferable.

What is claimed is:

1. An input control device with visual displays, comprising:

key operating means having plural switch means, a first sheet having a plurality of first designs thereon, said first sheet disposed at the front side of the key operating means, a display device having a plurality of light function elements, said light function elements having at least a light transmission state and a light shielding state, and said display device disposed at the front side of the first sheet, and a second sheet having a plurality of windows and second designs thereon, said second sheet disposed at the front side of the display device, wherein each window of the plurality of windows, and each light function element of the plurality of light function elements, and each first design of the plurality of first designs, and each switch means of the plural switch means are located at mutually opposite positions, such that when a pressing force is applied to one of the plural windows, the plural window, the underlying light function element, the underlying first designs on the first sheet, and the underlying switch means are each temporarily deformed such that said temporarily deformed switch means sets the light function element to its light transmission state by application of an electrical signal, thereby allowing the underlying first designs on the first design sheet to be displayed in the plural window.

2. An input control device with visual displays of claim 1, wherein each light function element of the plural light function elements has a liquid crystal material placed through a transparent sheet which can be deformed by pressing force and an electric field is applied to the liquid crystal material by each switching action of the plural switch means, and the light function element is set in the light transmission state by application of the electric field, and is set in light shielding state by cancellation of application of the electric field.

3. An operating apparatus of claim 1, wherein the each second display means is formed in each window or in the peripheral region thereof.

4. An operating apparatus of claim 1, wherein the each first display means is at least one selected from the group consisting of pattern, graphic, character, symbol, numeral and line.

5. An operating apparatus of claim 1, wherein the each second display means is at least one selected from the group consisting of pattern, graphic, character, symbol, numeral and line.

6. An operating apparatus of claim 1, wherein the first design sheet, display device, and second design sheet are integrated by adhering means.

7. An operating apparatus of claim 1, wherein the second design sheet includes ultraviolet ray barrier means for shielding ultraviolet rays.

8. An operating apparatus of claim 1, further comprising a sealing means disposed at a peripheral end of the display device.

9. An operating apparatus of claim 1, further comprising a frame for shielding static electricity disposed at the front side of the second design sheet.

10. A heating cooker comprising:

(a) a main body of a heating apparatus, and (b) an input control device with visual displays, comprising:

key operating means having plural switch means, a first sheet having a plurality of first designs thereon, said first sheet disposed at the front side of the key operating means, a display device having a plurality of light function elements, said light function elements having at least a light transmission state and a light shielding state, and said display device disposed at the front side of the first sheet, and a second sheet having a plurality of windows and second designs thereon, said second sheet disposed at the front side of the display device, wherein each window of the plurality of windows, and each light function element of the plurality of light function elements, and each first design of the plurality of first designs, and each switch means of the plural switch means are located at mutually opposite positions, such that when a pressing force is applied to one of the plural windows, the plural window, the underlying light function element, the underlying first designs on the first sheet, and the underlying switch means are each temporarily deformed, such that said temporarily deformed switch means sets the light function element to its light transmission state by application of an electrical signal, thereby allowing the underlying first designs on the first design sheet to be displayed in the plural window.

11. A heating cooker of claim 10, wherein the heating apparatus is a high frequency heating apparatus.

12. A heating cooker of claim 10, wherein the plural second display means is menu names for cooking.

13. A heating cooker of claim 10, wherein each second display means of the plural second display means is formed in a peripheral region of the each window.

14. A heating cooker of claim 10, wherein the each first display means is at least one selected from the group consisting of pattern, graphic, character, symbol, numeral and line.

15. An input control device with visual displays, comprising:

key operating means having plural switch means, a first sheet having a plurality of first designs thereon, said first sheet disposed at the front side of the key operating means, a display device having a plurality of light function elements, said light function elements having at least a light transmission state and a light shielding state, and said display device disposed at the front side of the first sheet, and a second sheet having a plurality of windows and second designs thereon, said second sheet disposed at the front side of the display device, and control means connected electrically to at least one of the display device and key operation means, wherein each window of the plurality of windows, and each light function element of the plurality of light function elements, and each first design of the plurality of first designs, and each switch means of the plural switch means are located at mutually opposite positions, such that when a pressing force is applied to each light function element of the plural light function elements, the light function element is temporarily deformed, and along with deformation of the light function element, by an electrical action of the key operation means, the pressed light function element functions to be in light transmission state, when a window of the plural windows is pressed and manipulated, the light function element located at the position corresponding to the manipulated window is set in light transmission state, and the first display element corresponding to the light function element in light transmission state is displayed in the manipulated window, and further to urge next operation, the light function element located at the position corresponding to other window out of the plural windows repeats light transmission state and light shielding state, and the first display means corresponding to the light function element repeating the light transmission state and light shielding state is displayed by flickering in the manipulated window.

16. An operating apparatus of claim 15, wherein each light function element of the plural light function elements has a liquid crystal material placed through a transparent sheet which can be deformed by pressing force, and an electric field is applied to the liquid crystal material by each switching action of the plural switch means, and the light function element is set in the light transmission state by application of the electric field, and is set in light shielding state by cancellation of application of the electric field.

17. A heating cooker comprising:

(a) a main body of a heating apparatus, and (b) an input control device with visual displays, comprising:

key operating means having plural switch means, a first sheet having a plurality of first designs thereon, said first sheet disposed at the front side of the key operating means, a display device having a plurality of light function elements, said light function elements having at least a light transmission state and a light shielding state, and said display device disposed at the front side of the first sheet, and a second sheet having a plurality of windows and second designs thereon, said second sheet disposed at the front side of the display device, and control means connected electrically to at least one of the display device and key operation means, wherein each window of the plurality of windows, and each light function element of the plurality of light function elements, and each first design of the plurality of first designs, and each switch means of the plural switch means are located at mutually opposite positions, such that when a pressing force is applied to each light function element of the plural light function elements, the light function element is temporarily deformed, and along with deformation of the light function element, by an electrical action of the key operation means, the pressed light function element functions to be in light transmission state, when a window of the plural windows is pressed and manipulated, the light function element located at the position corresponding to the manipulated window is set in light transmission state, and the first display element corresponding to the light function element in light transmission state is displayed in the manipulated window, and further to urge next operation, the light function element located at the position corresponding to other window out of the plural windows repeats light transmission state and light shielding state, and the first display means corresponding to the light function element repeating the light transmission state and light shielding state is displayed by flickering in the manipulated window.

18. A heating cooker of claim 17, wherein the heating apparatus is a high frequency heating apparatus.

19. A method of operating an input control device with visual displays, comprising the steps of:

(a) constituting an input control device with visual displays, said input control device comprising:

key operating means having plural switch means, a first sheet having a plurality of first designs thereon, said first sheet disposed at the front side of the key operating means, a display device having a plurality of light function elements, said light function elements having at least a light transmission state and a light shielding state, and said display device disposed at the front side of the first sheet, and a second sheet having a plurality of windows and second designs thereon, said second sheet disposed at the front side of the display device, and control means connected electrically to at least one of the display device and key operation means, wherein each window of the plurality of windows, and each light function element of the plurality of light function elements, and each first design of the plurality of first designs, and each switch means of the plural switch means are located at mutually opposite positions, and each light function element of the plurality of light function elements is deformable, (b) when a pressing force is applied to each light function element of the plurality of light function elements, the light function element is temporarily deformed, and along with deformation of the light function element, by an electrical action of the key operating means, the pressed light function element functions to be in light transmission state, pressing and manipulating a first window of the plural windows, accordingly, a first light function element located at the position corresponding to the first window is set in light transmission state and a first display element corresponding to the first light function element in light transmission state is displayed in the first window, and further to urge next operation, a second light function element located at the position corresponding to a second window out of the plural windows repeats light transmission state and light shielding state, and the other first display means corresponding to the second light function element repeating the light transmission state and light shielding state is displayed by flickering in the second window, (c) manipulating the second window which is flicking, accordingly, the second light function element located at the position corresponding to the second window is set in light transmission state, and the other first display element corresponding to the second light function element in light transmission state is displayed in the second window, and further to urge next operation, a third light function element located at the position corresponding to a third window out of the plural windows repeats light transmission state and light shielding state, and further other first display means corresponding to the third light function element repeating the light transmission state and light shielding state is displayed by flickering in the third window, (d) repeating the operation of step (c) as many times as required, and (e) finally manipulating the flickering window to start desired operation.

20. An operating method of an operating apparatus of claim 19 characterized by being mounted on a heating cooker.

21. An operating method of an operating apparatus of claim 20, wherein the heating cooker is a high frequency heating cooker.

22. An operating method of an operating apparatus of claim 20, wherein the plural second display means is menu names for cooking.

23. An operating method of an operating apparatus of claim 20, wherein the each first display means is at least one selected from the group consisting of pattern, graphic, character, symbol, numeral and line.

24. An operating method of an operating apparatus of claim 19, wherein the each light function element has a liquid crystal material, and the liquid crystal material is set in light transmission state by application of electric field and set in light shielding state by cancellation of application of electric field, by the action of the each switch means.

* * * * *

UNITED STATES PATENT AND TRADE MARK OFFICE

CERTIFICATE OF CORRECTION

PATENT NO. : 6,018,153
DATED : January 25, 2000
INVENTOR(S) : Matsuda et al.

It is certified that error appears in the above-identified patent and that said Letters Patent is hereby corrected as shown below:

Cover page, item [56] References Cited, U.S. Patent Documents, "4,972,069" should read --4,972,060--.

Signed and Sealed this

Twenty-seventh Day of March, 2001

Nicholas P. Godici

*Attest:*

NICHOLAS P. GODICI

*Attesting Officer*

*Acting Director of the United States Patent and Trademark Office*